US005711331A

United States Patent [19]

Harris

[11] Patent Number: 5,711,331

[45] Date of Patent: Jan. 27, 1998

[54] PORTABLE SHADE UNIT

[76] Inventor: Johnel Harris, 215 Timber Oaks Dr., North Aurora, Ill. 60542

[21] Appl. No.: 501,603

[22] Filed: Jul. 12, 1995

[51] Int. Cl.[6] ..... A45B 3/00

[52] U.S. Cl. ..... 135/16; 135/19; 135/20.1; 248/529

[58] Field of Search ..... 135/16, 19, 20.1, 135/20.3, 141, 142, 98, 99; 248/910, 519, 354.5, 200.1, 527, 528, 529

[56] References Cited

U.S. PATENT DOCUMENTS

| | | | |
|---|---|---|---|
| 2,734,555 | 2/1956 | Kroner | 248/528 X |
| 3,355,136 | 11/1967 | Staples | 248/354.5 X |
| 3,419,295 | 12/1968 | Small | 135/20.3 X |
| 3,521,651 | 7/1970 | Pearlstine | 135/20.1 |
| 3,701,504 | 10/1972 | Woods et al. | 248/528 X |
| 3,733,040 | 5/1973 | Rocquin | 248/529 X |
| 3,794,279 | 2/1974 | Kramer | 248/529 X |
| 4,674,522 | 6/1987 | Ma | 135/20.3 |
| 4,773,642 | 9/1988 | Cruz | 248/354.5 X |
| 4,877,045 | 10/1989 | Lin | 135/20.3 |
| 5,090,648 | 2/1992 | Wood, IV | 248/354.5 X |
| 5,261,434 | 11/1993 | Fodero | 135/16 |
| 5,377,976 | 1/1995 | Matherne et al. | 248/910 X |

FOREIGN PATENT DOCUMENTS

| | | | |
|---|---|---|---|
| 0994741 | 8/1976 | Canada | 248/910 |

*Primary Examiner*—Lanna Mai
*Attorney, Agent, or Firm*—John L. Schmitt

[57] ABSTRACT

A portable shade unit particularly adapted for ready assembly into a free standing configuration may be assembled from a kit of prepackaged components. These components include a weightable base formed with an inner space for ballast such as water or sand. On a top wall of the base are sets of clips to hold an adjustable standard, a tiltable knuckle connector, and a commercially available hand-held umbrella such as a golf umbrella. For assembly a lower end of an outer tube of the standard is fitted in a bushing on the base. An upper end of an inner member of the standard then is placed into a lower sleeve of the knuckle connector. Lastly, a handle end of the umbrella is fitted into an upper sleeve of the connector. A canopy of the umbrella then may be opened to provide shade or other protection from weather as required. Further, an angular position of the umbrella may be adjusted by releasing a pivot connection of the knuckle connector.

7 Claims, 2 Drawing Sheets

PORTABLE SHADE UNIT

BACKGROUND OF THE INVENTION

1. Field of Invention

This invention relates to portable shade units and more particularly to a unit comprising ready transportable components that may be assembled into a free standing, patio-type umbrella or shade unit, and then when not in use disassembled and secured as a kit for movement to and storage in a remote location.

2. Prior Art

Umbrellas have been known and in use for many years. Perhaps the best known model is the hand-held umbrella having an canopy which is expanded to form an envelope over an individual for protection from rain and sun. Sun protecting umbrellas also are referred to as parasols. Another popular model is the free-standing or patio umbrella that typically is used in a set location to provide shade for chair seated persons.

Umbrellas also are available in specialized configurations. For example, U.S. Pat. No. 2,390,952 discloses a parasol having cap-shaped straps joined to a bottom end of a handle. The straps allow the parasol to be fitted to and then carried on the head of a user. Also see U.S. Pat. No. 4,537,339 wherein a small head covering umbrella may be attached to a shoulder strap of a user, U.S. Pat. No. 5,172,711 showing an umbrella that includes a fan, and U.S. Pat. No. 5,273,062 wherein a beach-type umbrella includes a radio.

A still further umbrella, as set out in U.S. Pat. No. 4,788,996, is particularly adapted to cover a top open end of a golf bag. A vertical upright of this umbrella is affixed to a horizontal platform having an inverted U-shaped outer end bracket. For use the bracket slides downward over a top edge of a sidewall of the golf bag allowing an expanded canopy of the umbrella to cover golf clubs located inside the bag.

Lastly, U.S. Pat. No. 5,143,108 discloses another beach-type umbrella. In this case a bottom end of a pole of the umbrella fits into a base having insertible depending legs, several storage compartments, and a beverage can holder.

SUMMARY OF THE INVENTION

A portable shade unit of this invention includes a base having a sealable inner space. On a top wall of the base are three sets of clips and a bushing. Releasably fitting in the bushing is a lower end of a cylindrical standard. The standard includes a slidable inner member which fits inside an outer guide tube. The inner member is formed with a set of spaced apart apertures which may be respectively aligned with a pair of openings in the outer tube for insertion of a pin to selectively locate the inner slide member inside the outer guide tube.

A top end portion of the inner member fits into a bottom sleeve of a tiltable knuckle connector. Lastly, a bottom gripping end of a standard golf umbrella locates in a top sleeve of the connector.

During periods of non-use the components of the unit are disassembled. The standard, knuckle connector, and umbrella are secured respectively in the clip sets on the base to form a kit. A handle on the base makes the kit readily transportable.

For use the base may be prefilled with water or other ballast or such filling may be effected at the use location if ballast is available. For example, if the shade unit is to be used at a beach, then water or sand should be readily available at the point of use for filling the base. Once in its use location, the standard, knuckle connector and umbrella are removed from the clips and assembled into the unit described above.

The portable shade unit of this invention offers several advantages over other like devices known or presently in use.

A first advantage is that during periods of non-use the unit may be transported and stored in kit form. In this configuration the unit requires little storage space, and the components remain as a package. Thus, when use of the unit again is contemplated, there should be no missing components to inhibit assembly. In this kit form, the unit also is readily transportable, for example in a trunk of a car and then by hand to a final location.

A second advantage of this inventive shade unit is that the components may be readily assembled without need for tools. All component fits to assemble the unit are slide-interference fit type connections.

Another advantage is that a shading element of the unit is a standard, commercially available umbrella. If this umbrella were lost or if the canopy of such were to become damaged or worm, the umbrella of the shading element may be inexpensively replaced with a new one. Additionally, since the unit can provide decoration as well as function, umbrellas having different canopy color schemes and designs may be interchanged A still further advantage is that the unit is an effective protector in different locations and varying conditions. The base, when weighted, inhibits unit toppling. A strap attached to the standard may be connected to a chair of a user or other support member if further stability is required. Then, the height position of the standard inner slide member and the tilt and rotational position of the shading element may be adjusted to locate the canopy of the umbrella for optimal shading.

Finally, the umbrella of the shading element is usable as a standard hand-held umbrella if one needs protection when moving from an open area to a place of safety during a storm.

DESCRIPTION OF THE PREFERRED EMBODIMENT

Figure 1:
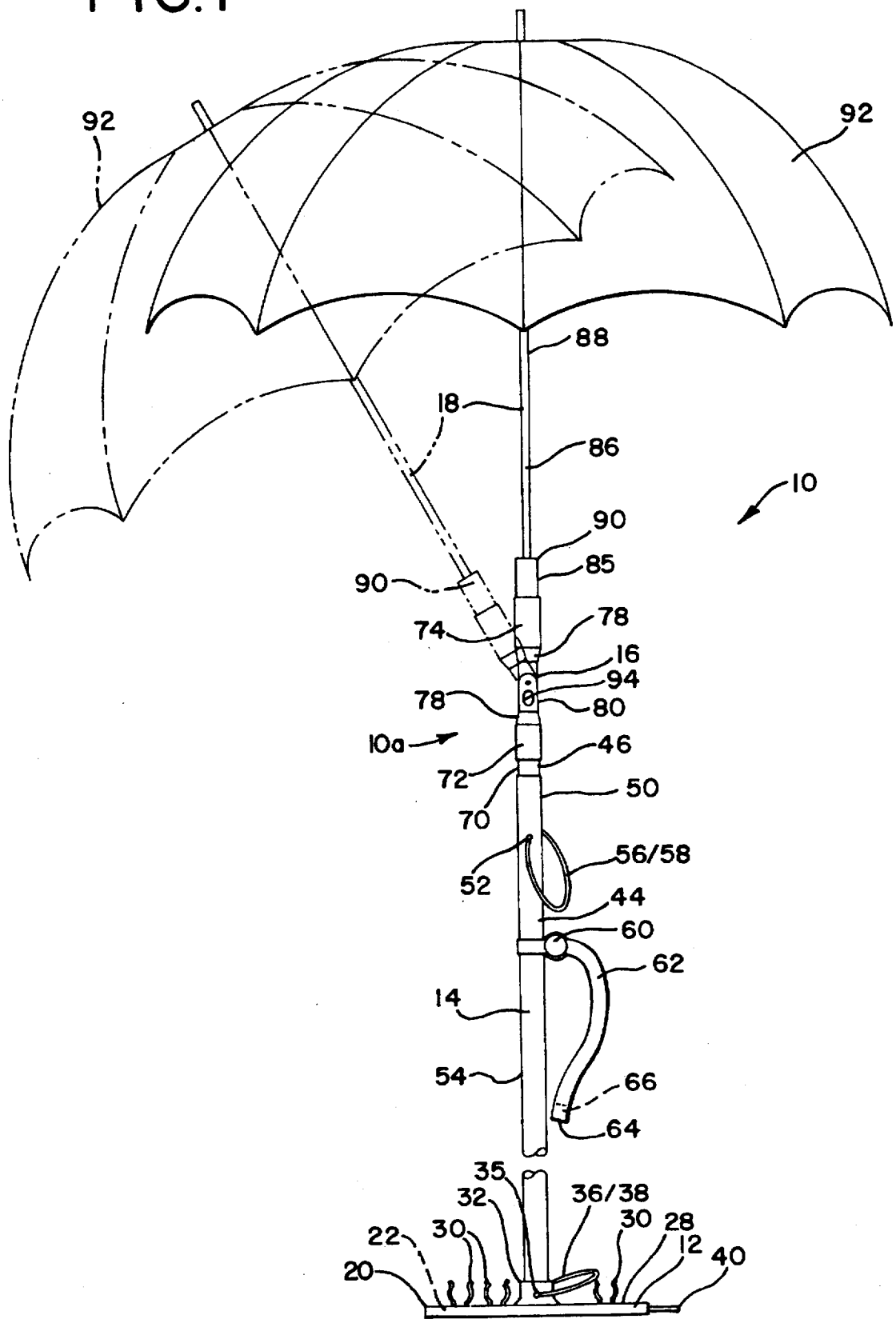
FIG. 1 is an elevational view of an assembled portable shade unit of this invention with phantom lines then showing a shading element of the unit in an optional tilted position.
Figure 2:
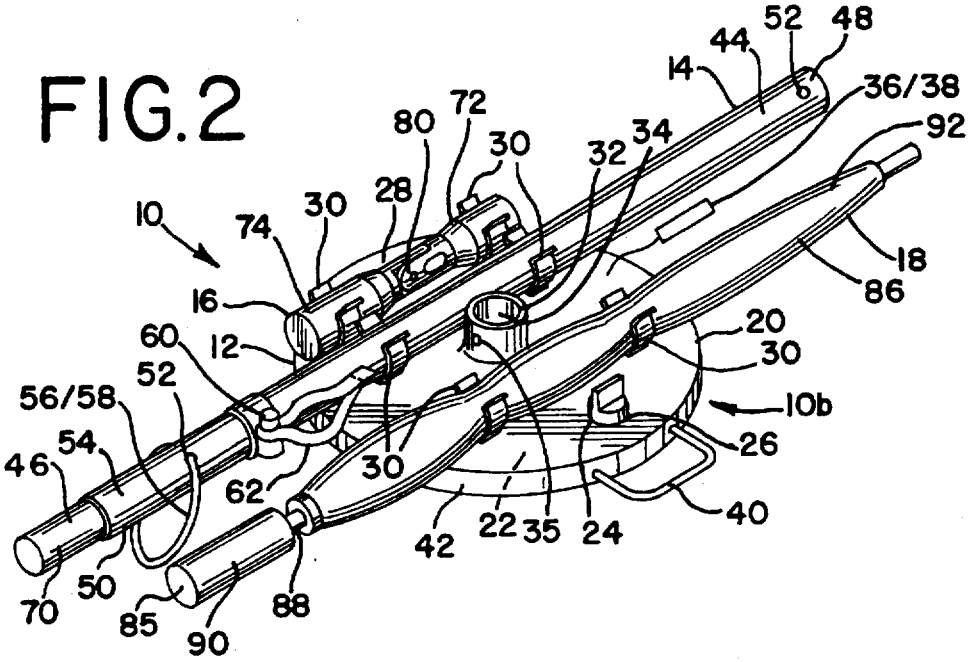
FIG. 2 is a perspective view of a disassembled unit formed into a kit which may be readily transported or stored.

A portable shade unit of this invention, as seen generally in FIGS. 1 and 2, is designated 10. When the unit 10 is assembled, as shown in FIG. 1, the unit 10 is designated **10*a*. When the unit 10 in a disassembled or kit form, as shown in FIG. 2, the unit 10 is designated 10*b***.

The unit 10 comprises a base 12, an adjustable standard 14, a tiltable knuckle connector 16, and a shading element 18. The base 12 has a round hollow body 20 defining an open inner space 22 for ballast discussed in greater detail below. The inner space 22 may be sealed by a plug 24 selectively fittable in an opening 26 formed in a top wall 28 of the base 12.

Also, on the base top wall 28 are three pairs of spaced apart spring clips 30 and a centrally located bushing 32. The bushing 32 has an upward facing interior space 34 and a pair of aligned openings 35 therethrough. Lastly, the base 12 has an attached string 36 for a connecting pin 38 and a looped shaped handle 40 which attaches to a circular sidewall 42 of the base 12.

Figure 3:
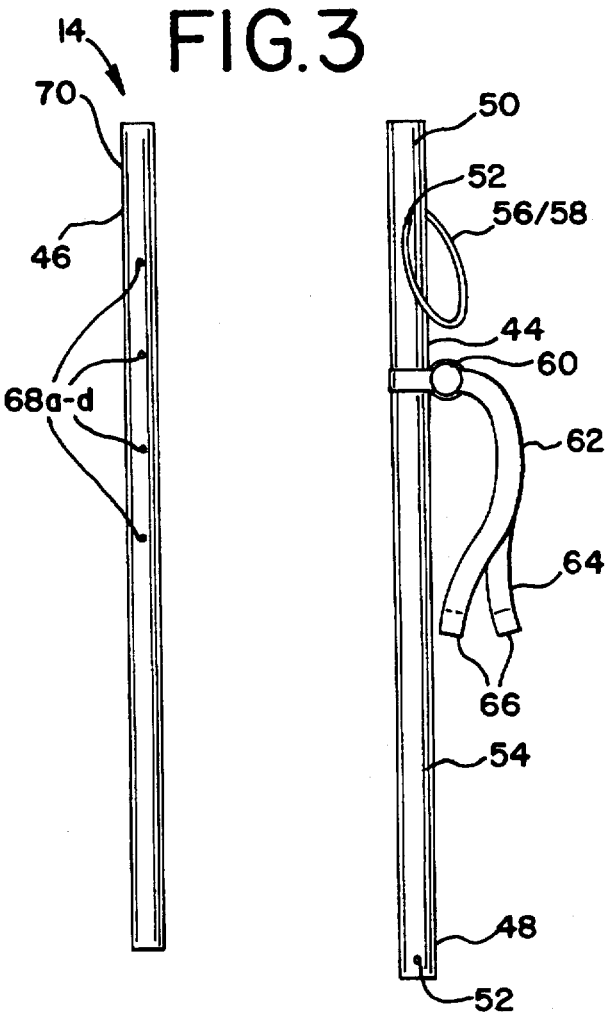
FIG. 3 is a detailed side elevational view of an outer guide tube and inner slide member of a standard of the unit.

The standard 14 of the shade unit 10 is shown in detail in FIGS. 1–3 and includes a hollow outer guide tube 44 for telescopic disposition of a solid inner slide member 46. Formed inward from a lower end 48 and upper end 50 of the outer tube 44 is a set of lower and upper aligned openings 52 in a sidewall 54 of the tube 44. Attached to the tube sidewall 54 just above the upper aligned openings 52 is a further string 56 and connecting pin 58 combination. Then, immediately below the tube upper opening pair 52 and likewise attached to the tube sidewall 54 is a ring 60 for a strap 62. Ends 64 of the strap 62 have Velcro pads 66 for releasably joining of the strap ends 64.

As seen in FIG. 3, the inner slide member 46 of the standard 14 is formed with a set of four transversely positioned, longitudinally spaced apart apertures 68*a–d*. The position of the inner member 46 in the outer tube 44 may be selectively located and then affixed in one of four positions by aligning one inner member aperture 68*a–d* with the tube sidewall upper openings 52. Once aligned, the pin 58 is inserted therethrough.

Regardless of which inner member aperture 64*a–d* of the standard 14 is selected, a top end portion 70 of the inner member 46 extends beyond the upper end 50 of the outer tube 44. When the pin 58 is in aperture 64*a*, for example, the inner member exposed top end portion 70 is approximately 2 in.

Figure 4:
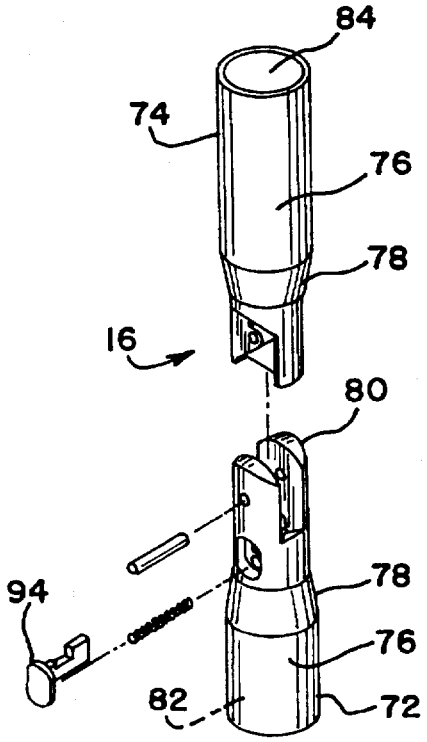
FIG. 4 is exploded view of a tiltable knuckle connector of the unit.

The tiltable knuckle connector 16, shown in detail in FIG. 4, comprises a lower sleeve 72 and an upper sleeve 74. Each sleeve 72, 74 has a hollow cylindrical outer end portion 76 which connects with a narrowing inner end portion 78. The outer end portion 76 of the upper sleeve 74 is about twice as long as the outer end portion 76 of the lower sleeve 72. The sleeve inner end portions 78 are firmly attached to respective ends of a lockable pivot joint 80.

The pivot joint 80 is commercial available, and the preferred joint 80 from Treasure Guard of Baldwin Park, Calif. 91706. An inner passageway 82 of the lower sleeve 72 is prepared to snugly receive the top end portion 70 of the standard inner member 46 while an inner passageway 84 of the knuckle connector upper sleeve 74 is prepared to receive a lower end 85 of the shading element 18. The preferred shading element 18 is one of any number of commercial available golf umbrellas 86 having a shaft 88 with a handle gripping end 90 that then fits in the inner passageway 84 of the knuckle connector upper sleeve 74.

When being stored or transported to and from places, the preferred form of the unit 10 is the kit 10*b*. As seen in FIG. 2, the standard 14, the knuckle connector 16, and the shading element 18 are dissembled and secured respectively in the clips sets 30 on the base top wall 28. Additionally, the base pin 38 and the standard pin 58 are inserted respectively in the base bushing pair of openings 35 and the standard outer tube-inner member upper opening pair 52 and aperture 68*a*. Without these insertions the pins 38, 58 would dangle and could be snagged by some foreign member.

Whether the base inner space 22 remains full of ballast or empty is a user option and will depend on such factors as the type of ballast, storage temperature, and the difficulty of the user handling a heavier kit 10*b*. If the ballast is liquid, for example water, and the base 12 is exposed to freezing temperatures, then the base inner space 22 should be emptied. Regardless, the base handle 40 provides convenient means for vertical support and handling of the kit 10*b*.

To place the unit 10 in its assembled form 10*a*, first the standard 14, the knuckle connector 16, and shading element 18 are removed from the base clips 30. Assuming that the base 12 contains no ballast, the base plug 24 may be removed to fill the base inner space 22 with sand or water, for example, to increase to the base weight to about 20 pounds.

With the base inner space 22 full and the base 12 firmly seated on ground, in sand or the like, the lower end 48 of the standard outer guide tube 44 is placed in the interior space 34 of the base bushing 32. The standard 14 then is secured in place by inserting the base pin 38 through aligning openings 35, 52 in the base bushing 32 and outer tube lower end 48.

Next the standard inner member top end portion 70 is slide into the inner passageway 82 of the knuckle connector lower sleeve outer end portion 76. Then, the handle end 90 of the umbrella shaft 88 is placed in the inner passageway 84 of the knuckle connector upper sleeve outer end portion 76. Lastly, a canopy 92 of the shading element 18 is expanded to provide shade from the sun shinning or cover from rain falling on a user therebelow.

During periods of higher than normal winds, additional stability for the assembled unit 10*a* can be provided by the strap 62. For example, the ends 64 of the strap 62 may be placed about an armrest of a chair (not shown) in which the user is seated. The strap Velcro end pads 66 then are pressed together to secure the assembled unit 10*a* to the chair.

Also, during periods of prolonged use, it may be necessary to adjust the location of the umbrella canopy 92 to maintain shade over the chair noted above. Since size and location of the shade area is continuously changing as the earth moves with respect to the sun, canopy shade may be optimized by raising or lowering the canopy 92 and then repositioning the shading element 18 on an angle. For example, the canopy 92 may be raised by removing the standard pin 58, repositioning the inner member 46 to align the aperture 36*b* with the outer tube upper opening pair 52, and then reinserting the pin 58. The angular position of the shading element 18 is adjusted by pressing inward a spring biased release button 94 on the knuckle connector pivot joint 80. When the button 94 is pressed, the connector upper sleeve 74 may be tilted 30 deg. right or left, see FIG. 1, and then fixed in that location by releasing the button 94.

As would be appreciated, the unit 10 may be converted from its assembled form 10*a* to its kit form 10*b* by reversing the steps of the above described procedure.

While an embodiment, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A portable shade unit adapted to be in a kit form for storage and readily assembled for use, said shade unit in said kit form comprising:

a weightable base, an adjustable standard releasably attached to said base, a connector releasably attached to said base, a shading element releasably attached to said base, said base further including a top wall, a sealable inner space to receive a ballast, sets of spaced apart spring clips attached to a top wall of said base to hold said standard, said connector, and said shading element in a horizontal manner for storage, and a bushing attached to said top wall of said base.

2. A shade unit as defined by claim 1 and further characterized by said standard including, an outer tube, said outer tube having a set of lower aligned openings formed inward from a bottom end of said tube with said tube bottom end prepared to releasably fit in said base bushing and be selectively secured therein by a pin inserted through said lower aligned opening set, an inner member slidably disposed in said outer tube, said inner member having a top end portion prepared to releasably fit in a lower sleeve of said connector, and a set of longitudinally, spaced apart apertures in said inner member selectively alignable with a set of upper aligned openings in said outer tube for insertion of a further pin to affix a position of said inner member with respect to said outer tube that exposes a selective length of said inner member top end portion.

3. A shade unit as defined by claim 1 and further characterized by said connector including, a knuckle connector having a lower sleeve and an upper sleeve joined to and spaced apart by a tiltable pivot joint, said lower sleeve having a passageway prepared to releasably recieve a top end portion of an inner member of said standard, and said upper sleeve having an inner passageway prepared to releasably receive a lower end of said shading element.

4. A shade unit as defined by claim 1 and further characterized by, said shading element being a golf umbrella having a shaft with a gripping end prepared to be releasably carried by said connector.

5. A unit particularly adapted to provide protection from the sun or rain for a user positioned under said unit, said unit comprising:

a base having an inner space for selective containment of ballast to provide extra weight to said unit and clip means attached to a top wall of said base, an adjustable standard having a stationary portion releasably carried by said base, a tiltable knuckle connector releasably carried by a top end portion of an adjustable inner member of said standard, and a shading element having an expandable canopy connecting with a lower gripping end releasably carried by an opposite end of said knuckle connector, wherein during periods of use an expanded canopy of said shading element be raised or lowered by selective movement of said standard adjustable inner member, and during periods of non-use said shading element, said knuckle connector, and said standard be disconnected and then selectively placed in said base clip means to transform said unit in a kit for travel or storage.

6. A shade unit comprising:

a base having a top wall carrying an upward facing bushing and three pairs of spaced apart spring clips, a standard defined in apart by an inner member slidably disposed in an outer guide tube having a lower end releasably carried in said base bushing, a knuckle connector having a pair of sleeves spaced apart by and joined to a tiltable pivot joint, each said sleeve formed with an inner passageway with a top end portion of said standard inner member releasably carried in one said sleeve inner passageway, and a shading element comprising an umbrella having a gripping handle end releasably carried in said other knuckle connector sleeve inner passageway, wherein during use said unit provides an area of shade selectively adjustable by placement of said base, by a location of said standard inner member in said standard outer guide tube, and by an angular position of said shading element umbrella, and during periods of non-use said shading element, said knuckle connector, and said standard be readily disconnected and then selectively placed in said pairs of said spring clips to transform said unit in a kit for travel or storage.

7. A shade unit as defined by claim 6 and further characterized by including, a pair of string-pin sets attached respectively to said base and said standard outer tube, a pair of openings formed in said base bushing, a pair of lower and upper openings formed in said standard outer guide tube, and a set of longitudinally spaced apart apertures formed in the standard inner member, wherein said base string-pin set may be used to releasably secure said standard to said base by inserting said base pin through said bushing-standard outer tube lower openings, and said standard string-pin set may be used to secure a selective position of said standard inner member in said standard outer tube by inserting said standard pin through said outer tube upper openings and one said inner member aperture.

* * * * *